US005265961A

United States Patent [19]

Boyd

[11] Patent Number: 5,265,961

[45] Date of Patent: Nov. 30, 1993

[54] PLASTIC GROCERY BAG HAVING DRAW-TAPE CLOSURE AND FLAT BOTTOM

[75] Inventor: Dana M. Boyd, Rushville, N.Y.

[73] Assignee: Mobil Oil Corporation, Fairfax, Va.

[21] Appl. No.: 759,354

[22] Filed: Sep. 13, 1991

[51] Int. Cl.[5] ..... B65D 33/28

[52] U.S. Cl. ..... 383/75; 383/38; 383/104; 383/120

[58] Field of Search ..... 383/38, 72, 75, 104, 383/120, 121

[56] References Cited

U.S. PATENT DOCUMENTS

| | | | |
|---|---|---|---|
| 2,280,601 | 4/1942 | Otter | 383/38 |
| 2,555,820 | 6/1951 | Satz | 383/120 X |
| 2,886,085 | 5/1959 | Sanger | 383/120 |
| 3,023,948 | 3/1962 | Hoeppner | 383/38 X |
| 3,077,295 | 2/1963 | Whiteford | 383/104 X |
| 3,078,895 | 2/1963 | Silver | 383/120 X |
| 3,425,470 | 2/1969 | Wuest | 383/120 X |
| 3,460,741 | 8/1969 | Kugler | 383/38 |
| 3,543,999 | 12/1970 | Kugler | 383/38 X |
| 3,774,838 | 11/1973 | Christie . | |
| 3,982,687 | 9/1976 | Auer et al. . | |
| 4,165,832 | 8/1979 | Kuklies et al. . | |
| 4,260,003 | 4/1981 | Hendrickson . | |
| 4,299,324 | 11/1981 | Dickens | 383/38 X |
| 4,354,335 | 10/1982 | Meyer . | |
| 4,547,237 | 10/1985 | Hendrickson . | |
| 4,558,463 | 12/1985 | Boyd . | |
| 4,696,403 | 9/1987 | Hoover | 383/38 X |
| 4,759,467 | 7/1988 | Byrne | 383/38 X |
| 4,768,818 | 9/1988 | Kolic | 383/93 X |
| 4,769,126 | 9/1988 | Roen et al. | 383/38 X |
| 4,786,275 | 11/1988 | Hoover | 383/38 X |
| 4,802,582 | 2/1989 | Johnson . | |
| 4,832,677 | 5/1989 | Hudgens et al. . | |
| 4,867,735 | 9/1989 | Wogelius . | |
| 4,872,766 | 10/1989 | Dancy | 383/38 X |
| 4,889,522 | 12/1989 | Gietman . | |

FOREIGN PATENT DOCUMENTS

| | | | |
|---|---|---|---|
| 3805054 | 8/1989 | Fed. Rep. of Germany | 383/38 |
| 1176612 | 1/1970 | United Kingdom | 383/75 |

*Primary Examiner*—Allan N. Shoap
*Assistant Examiner*—Jes F. Pascua
*Attorney, Agent, or Firm*—Alexander J. McKillop; Charles J. Speciale

[57] ABSTRACT

A thermoplastic bag for carrying groceries has a draw-tape and bottom closure which includes gusset panels which permit expansion to a flat bottom. The draw-tape and flat bottom obviate the "tipping" problem for grocery bags. Divider panels separate the bag into two compartments in which different types of groceries can be loaded.

6 Claims, 3 Drawing Sheets

PLASTIC GROCERY BAG HAVING DRAW-TAPE CLOSURE AND FLAT BOTTOM

FIELD OF THE INVENTION

This invention relates to thermoplastic grocery bags having improved grocery handling characteristics.

BACKGROUND OF THE INVENTION

Bags made of plastic film such as thin polyethylene film have been used in various sizes Small bags are used in the packaging of sandwiches and the like; larger bags are used as grocery bags and even larger bags are used for containing trash. The present invention is particularly related to the medium-size grocery bags where the loading of the bag is through an open top. So-called "T-shirt" grocery bags of the type shown in the Kuklies, et al U.S. Pat. No. 4,165,832 have been extensively used for packing and carrying groceries from retail markets. These T-shirt bags are inexpensive, strong, easy to carry by their integral handles, and have been widely used successfully. The most common complaint about these bags is that when they are placed on a seat or in the trunk of a car, the loaded bags often tip over, spilling their contents.

Proposals have been made for closures for grocery bags. U.S. Pat. No. 3,774,838-Christie shows a plastic bag with a detachable tie which can be used to close the open top of the bag.

Bags used for other purposes have utilized a draw tape closure. U.S Pat. No. 4,558,463-Boyd describes a thermoplastic trash bag with a draw tape closure The "tipping" problem would be at least partially obviated if thermoplastic grocery bags had a truly flat bottom when filled with groceries. The common T-shirt bag such as in Kuklies, et al has a partially flat bottom because of the side gussets which expand to present a flat bottom when the bag is filled Bottom-gusseted bags have also been used. U.S. Pat. No. 3,982,687-Auer discloses a bottom-gusseted bag with a top closure which includes a strap which can be detached from the bag and used to close the top of the bag.

For various reasons, the foregoing and other proposals for avoiding the grocery bag tipping and spilling problem have not been successful.

It is an object of the present invention to provide a thermoplastic bag with an integral draw tape to close the top of the bag and a bottom gusset which expands to present a flat bottom when the bag is filled with groceries.

SUMMARY OF THE INVENTION

In accordance with the invention, a thermoplastic grocery bag has an integral draw tape which can be pulled to close the bag when it is filled with groceries. The bag has a bottom gusset with gusset panels of sufficient width to form a full flat bottom when the bag is filled with groceries In accordance with one embodiment of the invention, the bottom has multiple gussets with pairs of gusset panels joined by fold lines.

In accordance with another embodiment of the invention, a divider panel separates the bag into two compartments in which different types of groceries can be loaded Gussets in the bottom of each compartment allow expansion of each into a flat bottom.

The foregoing and other objects, features and advantages of the invention will be better understood from the following detailed description and appended claims.

SHORT DESCRIPTION OF THE DRAWINGS

DESCRIPTION OF THE PREFERRED EMBODIMENT

Figure 1:
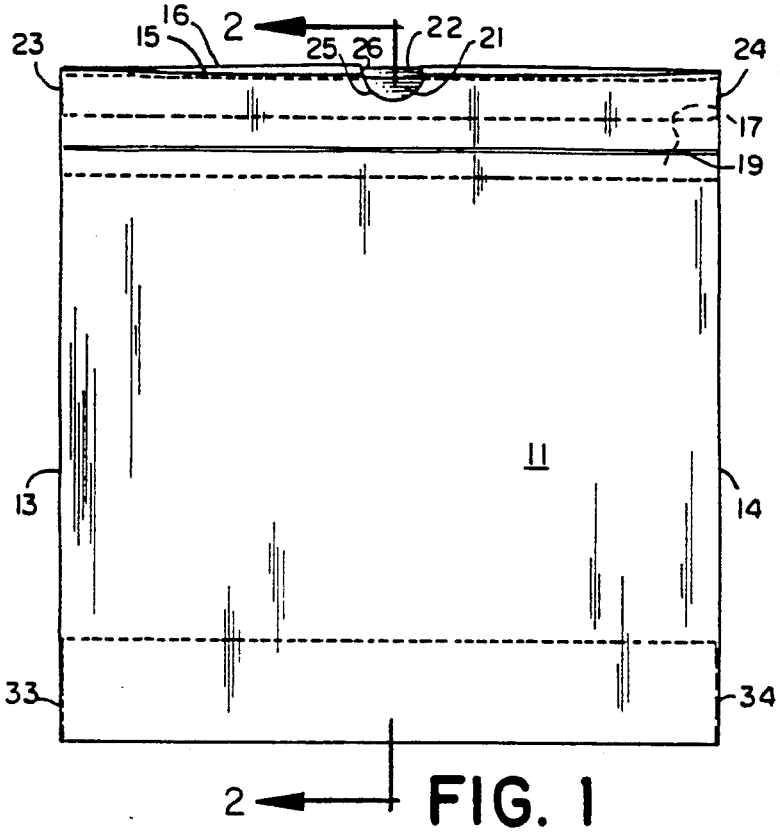
FIG. 1 shows a plan view of one embodiment of the invention.
Figure 2A:
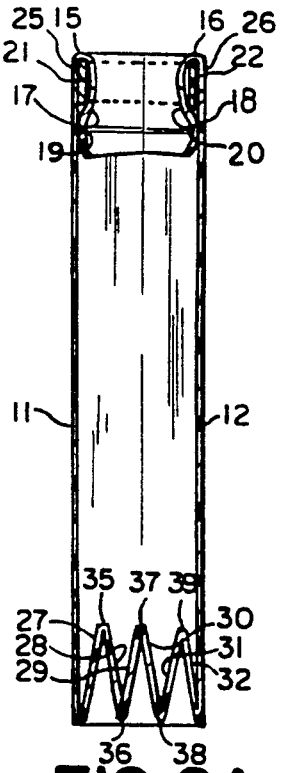
FIG. 2A is a cross-section of the bag of FIG. 1 on the section 2—2 before loading.
Figure 2B:
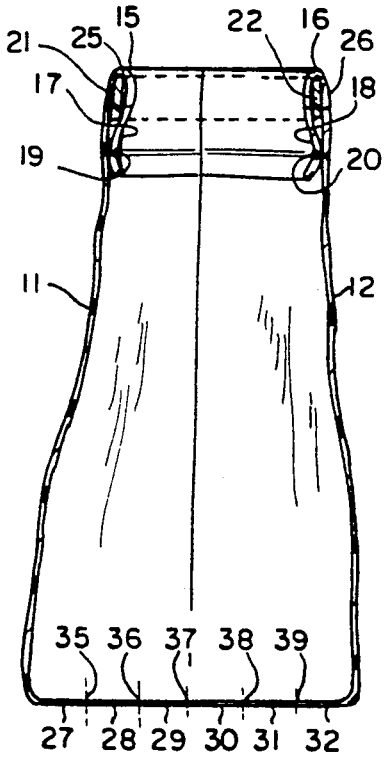
FIG. 2B is a cross-section of the bag of FIG. 1 on the section 2—2 after loading.
Figure 4:
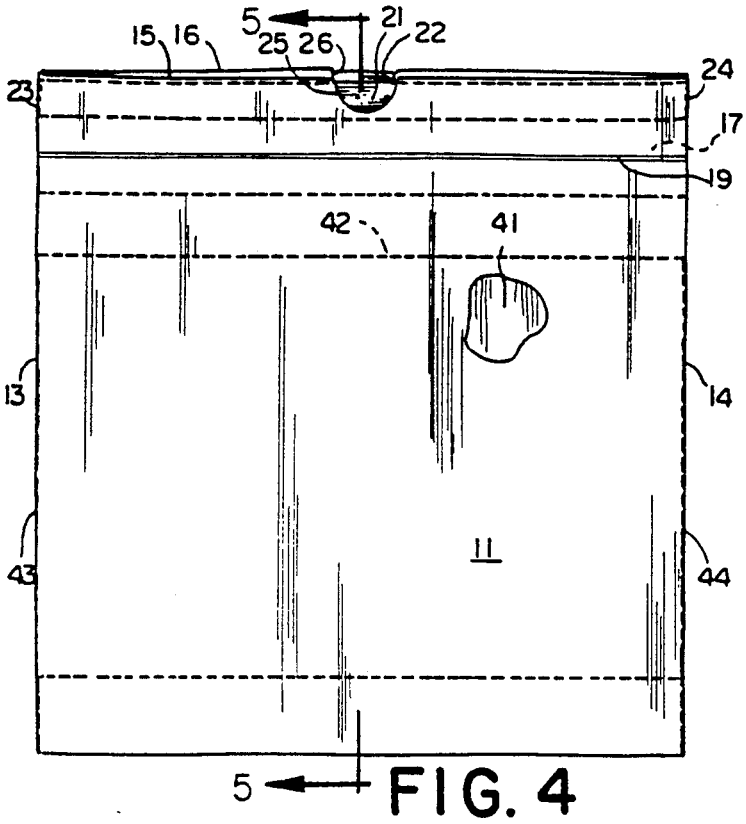
FIG. 4 is a plan view of an embodiment of the invention having divider panels.
Figure 5A:
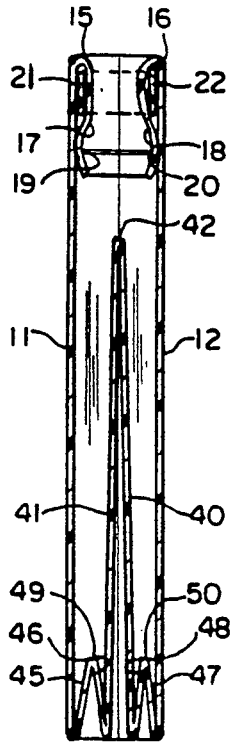
FIG. 5A is a cross-section of the bag of FIG. 4 on the line 5—5 before the bag is loaded.
Figure 6:
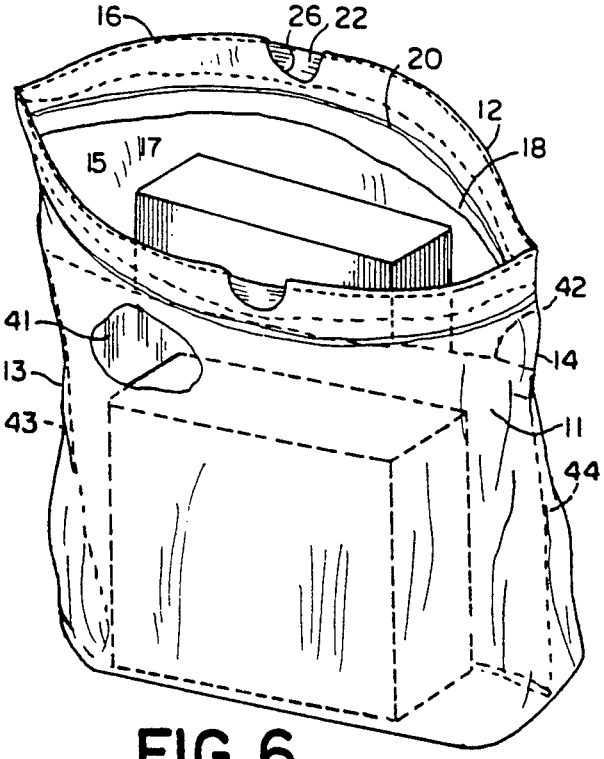
FIG. 6 is a perspective view of the bag of FIG. 4.
Figure 5B:
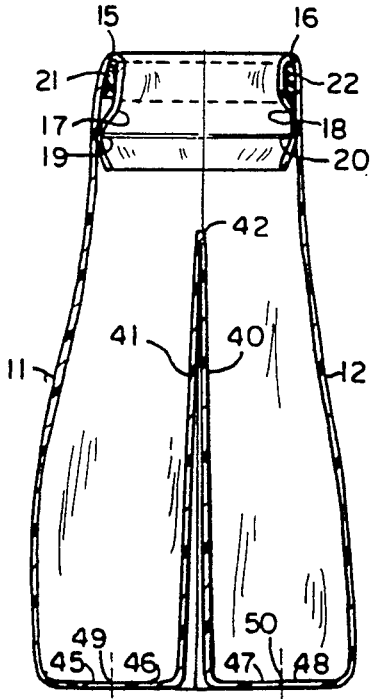
FIG. 5B is a cross-section of the bag of FIG. 4 on the line 5—5 after the bag is loaded.
Figure 7:
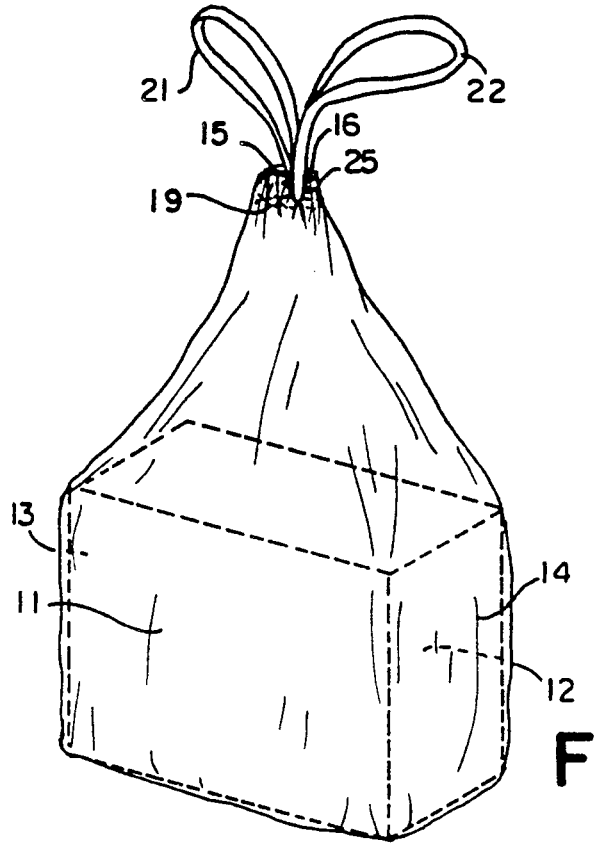
FIG. 7 shows the bag of FIG. 1 loaded and with the draw tape closed.
Figure 8:
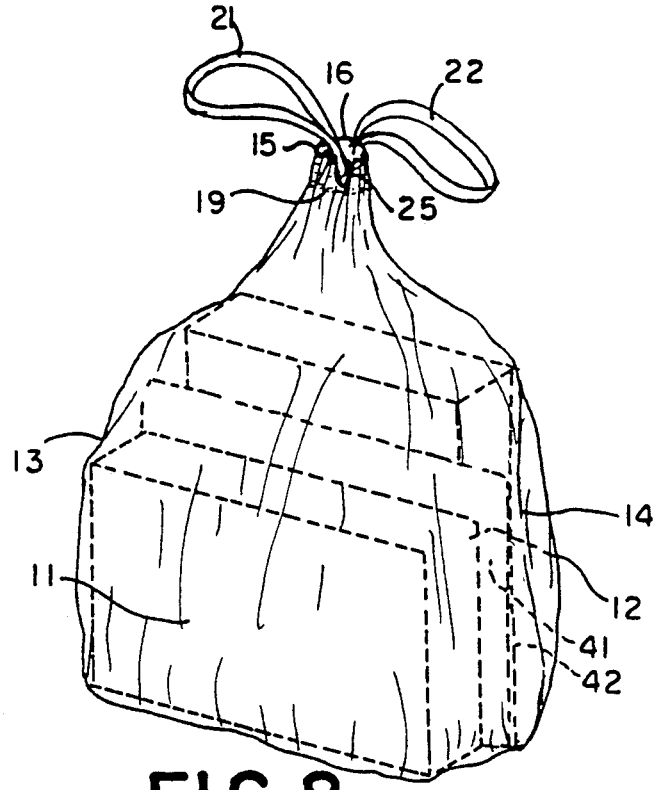
FIG. 8 shows the bag of FIG. 1 loaded and with the draw tape closed.

As shown in FIGS. 1 and 2, the bag of the present invention has a front wall 11 and a back wall 12 joined to each other along the sides 13 and 14. The top edges 15 and 16 define an open mouth for the bag. Hem portions 17 and 18 are folded over inside the bag along the top edges. The hem portions are sealed along the seals 19 and 20 to form a channel. Draw tapes 21 and 22 are disposed in the two hem channels. The draw tapes are heat-sealed at the edges 23 and 24 to secure the tape to the sides of the walls. The heat seal is part of the heat seal which extends along the side edges 13 and 14 of the bag.

A cut-out 25 and 26 in the top edge of each wall exposes the draw tape so that it can be grasped and used to carry the bag. The bottom closure of the bag includes multiple gusset panels 27–32. The gusset panels 27 and 32 are joined to the bottom edges of the front and back wall of he bag. Gusset panels 27 and 28 are joined together along the gusset fold line 35. Gusset panels 28 and 29 are joined together along gusset fold line 36 Similarly, gusset panels 29, 30, 31 and 32 are joined together along the gusset fold lines 37–39.

Figure 3:
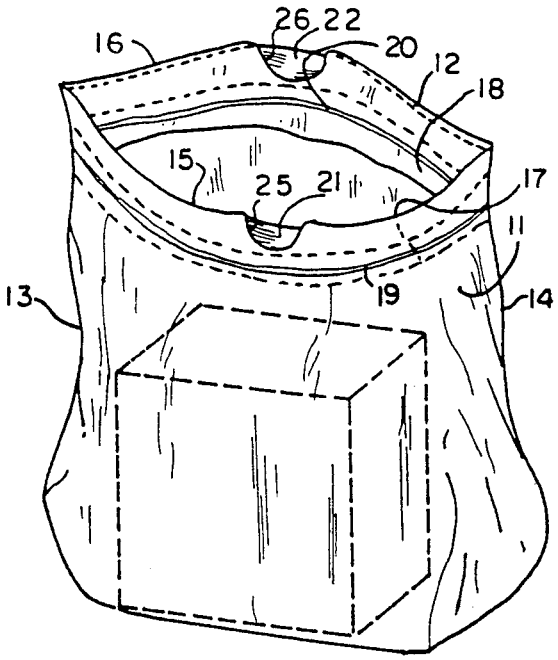
FIG. 3 is a perspective view showing the bag in its fully loaded condition.

The gusset panels in their totality have a sufficient width for the bottom closure to expand to a flat bottom when the bag is filled with groceries FIG. 3 is a perspective view showing a loaded bag filled with groceries which will sit squarely without tipping. The closed draw tapes at the top of the bag prevent accidental spilling of the groceries FIGS. 4, 5A, 5B, 6 and 8 show a modification of the invention in which divider panels 40 and 41 extend from a junction with a gusset panel at the bottom of the bag to a top fold line 42. The top fold line 42 is shown almost at the top of the bag, but it can be lower than this. The divider panels are sealed at 43 and 44 to the sides of the bag. The divider panels divide the bag into two compartments which can be loaded with different types of groceries. For example, it is often desirable to keep frozen foods away from warmer foods. The bag can be divided into a number of different compartments by panels provided in this manner. Because the panels are joined at their bottom to gusset panels 45–48, there is no problem in expanding the bottom of each compartment of the bag. This would otherwise be a problem because the divider panel seal at the edge of the bag would form a trapped gusset at the bottom corners of the bag.

Bags of the structures described can be formed by employing any suitable thermoplastic material, such as a polyolefin, and more particularly, polyethylene of any gauge. Gauges ranging from about 0.25 to about 5 mils are contemplated. In employing the term "polyethylene" it is employed generically to include all forms of polyethylene, including low density polyethylene, linear low density copolymers of ethylene and another alpha-olefin, high density polyethylene, mixtures and blends of the same. The contemplated bags of the present invention can be formed by utilizing conventional bag making technology modified by the inclusion of folding means to include gussets where desired in the bag structure.

While a particular embodiment of the invention has been shown and described, various modifications of the invention are within the true spirit and scope of the invention. The appended claims are, therefore, intended to cover all such modifications.

What is claimed is:

1. A thermoplastic bag for carrying groceries comprising:

a front wall and back wall of opposed layers of thermoplastic sheet material each having bottom edge, top edges and side edges, said front wall and back wall being joined to each other along the side edges to form the bag;

said top edges of said walls defining an open mouth for the bag;

a hem portions along said top edges, said hem portions being formed by said front and back walls being folded over adjacent said top and sealed between said hem portions and the adjacent portions of said front and back walls to form two channels;

at least one draw tape in the channels formed by said hem portions;

a bottom closure for said bag including at least two pairs of gusset panels, one gusset panel of each pair being jointed along one edge to the bottom edge of respective front and back walls and each pair of gusset panels being joined to the side edges of the front and back wall panels;

said gusset panels of each pair being joined to each other along a common fold line, each of said panels being sufficiently wide from the bottom edge of the bag to said gusset fold line to permit expansion of said bottom closure to a flat bottom when said bag is filled; and the two pairs of gusset panels being joined to each other by two divider panels, each divider panel extending from the edge of a gusset panel upwardly to almost the mouth of said bag, said divider panels being sealed to the side edges of said front and back walls to divide said bag into at least two compartments for holding different types of groceries.

2. The bag recited in claim 1 wherein said hem portion is inside said bag.

3. The bag recited in claim 1 wherein a separate draw tape is disposed in the channel formed by the hem portion of each of said front and back walls and wherein said draw tapes are sealed to said bag at the edges of said bag.

4. The bag recited in claim 3 wherein the draw tape is secured at the sides of said front and back walls by heat seals which extend along the sides of said walls.

5. The bag recited in claim 1 wherein each draw tape is exposed by a cut-out in each panel and each hem portion at the middle of the bag.

6. The bag recited in claim 1 wherein said bag and draw tapes are made from the same polyethylene material.

* * * * *